US010678182B2

(12) United States Patent
Shimizu et al.

(10) Patent No.: US 10,678,182 B2
(45) Date of Patent: Jun. 9, 2020

(54) DEVELOPING CARTRIDGE INCLUDING ENGAGING MEMBER MOVABLE WITH HELICAL GEAR AND ENGAGEABLE WITH GEAR COVER

(71) Applicant: BROTHER KOGYO KABUSHIKI KAISHA, Nagoya-shi, Aichi-ken (JP)

(72) Inventors: Keita Shimizu, Nagoya (JP); Tomitake Aratachi, Toyokawa (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/229,168

(22) Filed: Dec. 21, 2018

(65) Prior Publication Data

US 2019/0265638 A1 Aug. 29, 2019

(30) Foreign Application Priority Data

Feb. 28, 2018 (JP) ..... 2018-034778

(51) Int. Cl.
*G03G 21/16* (2006.01)
*G03G 15/08* (2006.01)
*G03G 21/18* (2006.01)

(52) U.S. Cl.
CPC ..... *G03G 21/1647* (2013.01); *G03G 15/0865* (2013.01); *G03G 15/0889* (2013.01);
(Continued)

(58) Field of Classification Search
CPC ..... G03G 15/0865; G03G 15/0889; G03G 21/1647; G03G 21/1857; G03G 21/186; G03G 2221/1657
See application file for complete search history.

(56) References Cited

U.S. PATENT DOCUMENTS 10,054,901 B1 * 8/2018 Fukamachi ..... G03G 21/1676
2007/0189804 A1 * 8/2007 Yasumitsu ..... G03G 21/1633 399/111

(Continued)

FOREIGN PATENT DOCUMENTS

EP 3 282 321 A1 2/2018
JP 2015-129806 A 7/2015

OTHER PUBLICATIONS

Extended European Search Report issued in related European Patent Application No. 18248151.5, dated Jul. 2, 2019.

*Primary Examiner* — Ryan D Walsh
(74) *Attorney, Agent, or Firm* — Merchant & Gould P.C.

(57) ABSTRACT

A developing cartridge includes: a housing; a developing roller rotatable about an axis extending in an axial direction; a first helical gear and a second helical gear positioned at an outer surface of the housing; a cover covering part of the second helical gear; and an engaging member movable with the second helical gear. The second helical gear meshes with the first helical gear and is rotatable in first and second rotational directions. The second helical gear is movable in the axial direction between a first position and a second position farther away from the outer surface than the first position. The second helical gear rotates in the first rotational direction to move to the first position. The second helical gear rotates in the second rotational direction to move to the second position whereby the engaging member engages part of the cover to terminate rotation of the second helical gear.

17 Claims, 7 Drawing Sheets

(52) U.S. Cl.
CPC ..... *G03G 21/186* (2013.01); *G03G 21/1857* (2013.01); *G03G 2221/1657* (2013.01)

(56) References Cited

U.S. PATENT DOCUMENTS

| | | | | |
|---|---|---|---|---|
| 2012/0195634 | A1* | 8/2012 | Kuriki | G03G 15/0808<br>399/281 |
| 2015/0192891 | A1 | 7/2015 | Noda et al. | |
| 2015/0277282 | A1* | 10/2015 | Taguchi | G03G 15/0865<br>399/12 |
| 2016/0011542 | A1* | 1/2016 | Mori | G03G 21/1857<br>399/262 |
| 2016/0370757 | A1* | 12/2016 | Sato | G03G 21/1647 |
| 2017/0327327 | A1 | 11/2017 | Kawashima | |
| 2018/0095410 | A1* | 4/2018 | Itabashi | G03G 15/0896 |
| 2018/0095411 | A1* | 4/2018 | Itabashi | G03G 15/0896 |

* cited by examiner

DEVELOPING CARTRIDGE INCLUDING ENGAGING MEMBER MOVABLE WITH HELICAL GEAR AND ENGAGEABLE WITH GEAR COVER

CROSS REFERENCE TO RELATED APPLICATION

This application claims priority from Japanese Patent Application No. 2018-034778 filed Feb. 28, 2018. The entire content of the priority application is incorporated herein by reference.

TECHNICAL FIELD

The present disclosure relates to a developing cartridge including a developing roller and a gear rotatable in accordance with rotation of the developing roller.

BACKGROUND

Conventionally, there are known developing cartridges each including a developing roller and gears rotatable in accordance with rotation of the developing roller, such as a developing gear, a supply gear, and an agitator gear, for example.

SUMMARY

In a state where the developing cartridge is attached to an image-forming apparatus, one of the gears rotates in a first rotational direction upon receipt of a driving force from the image-forming apparatus, thereby rotating the developing gear in a prescribed rotational direction to enable the image-forming apparatus to perform image formation. On the other hand, in a case where the gear rotates in a second rotational direction opposite to the first rotational direction, the developing roller is caused to rotate in a direction opposite to the prescribed rotational direction, which may result in leakage of developing agent.

In view of the foregoing, it is an object of the present disclosure to provide a structure capable of restricting a gear rotatable in accordance with rotation of a developing roller from rotating in a direction opposite to a prescribed rotational direction.

In order to attain the above and other objects, according to one aspect, the present disclosure provides a developing cartridge including a housing, a developing roller, a first helical gear, a second helical gear, a cover and an engaging member. The housing is configured to accommodate toner therein and has an outer surface. The developing roller is rotatable about a first axis extending in an axial direction. The first helical gear is positioned at the outer surface and is rotatable about a second axis extending in the axial direction. The first helical gear is rotatable in accordance with rotation of the developing roller. The second helical gear is positioned at the outer surface and is rotatable in a first rotational direction and a second rotational direction opposite to the first rotational direction about a third axis extending in the axial direction. The second helical gear is movable in the axial direction between a first position and a second position positioned farther away from the outer surface than the first position is from the outer surface. The second helical gear is moved to the first position by a first thrust force generated by meshing engagement between the first helical gear and the second helical gear in a case where second helical gear rotates in the first rotational direction. The second helical gear is moved to the second position by a second thrust force generated by the meshing engagement between the first helical gear and the second helical gear in a case where the second helical gear rotates in the second rotational direction. The cover is positioned at the outer surface and covers at least part of the second helical gear. The engaging member is rotatable about the third axis together with the second helical gear and is movable in the axial direction together with the second helical gear. The second helical gear is rotatable in the first rotational direction in accordance with the rotation of the first helical gear in a case where the second helical gear is at the first position. The engaging member is engaged with a part of the cover to terminate the rotation of the second helical gear in the second rotational direction in a case where the second helical gear is at the second position.

DETAILED DESCRIPTION

Hereinafter, one embodiment of the disclosure will be described in detail while referring to accompanying drawings.

Figure 1:
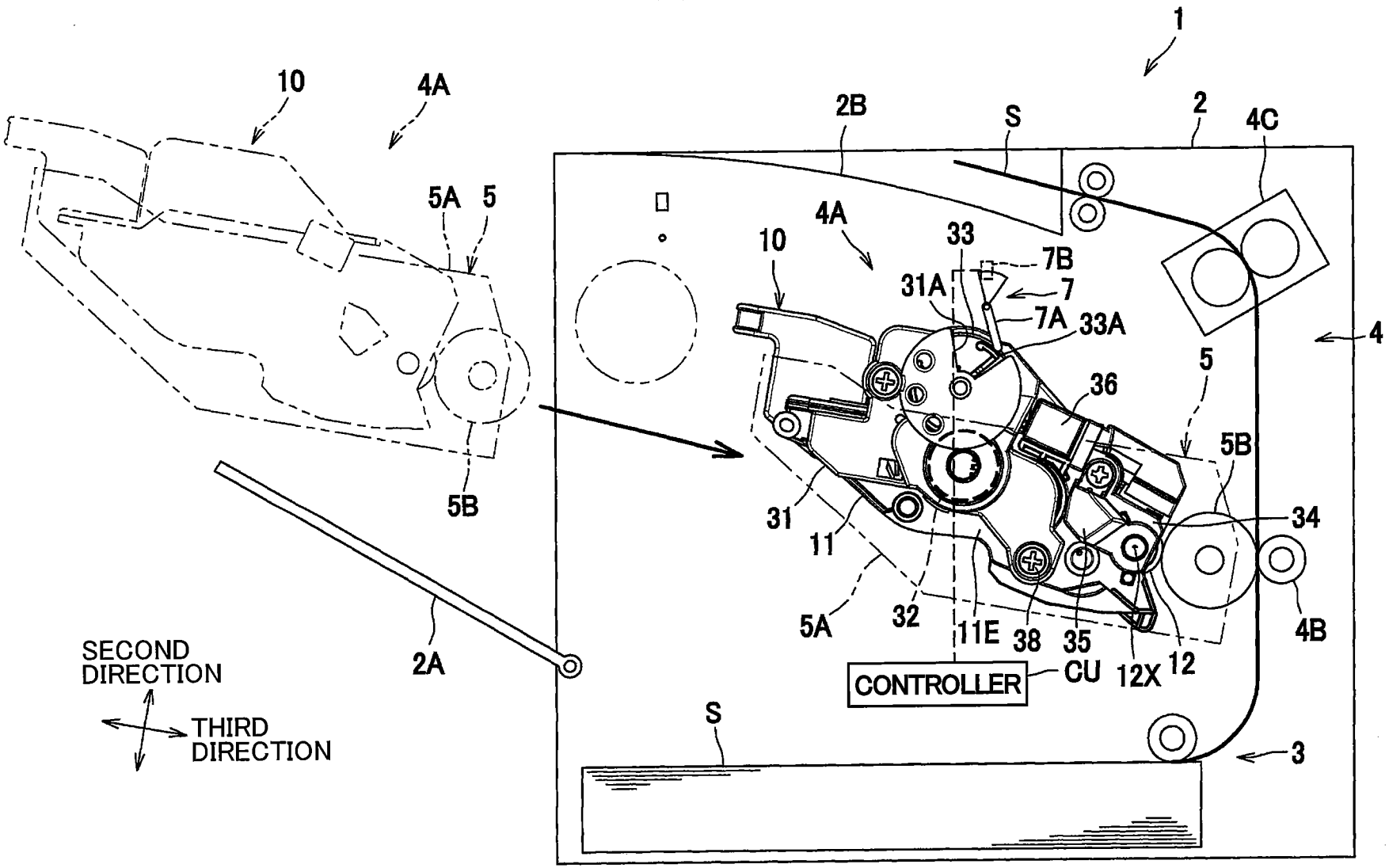
FIG. 1 is a schematic view illustrating an internal structure of a printer that can accommodate a developing cartridge according to an embodiment of the present disclosure.

As illustrated in FIG. 1, a laser printer 1 of the embodiment mainly includes a main casing 2, a sheet feeding portion 3, an image forming portion 4, and a controller CU. The laser printer 1 is an image-forming apparatus configured to form images onto sheets S.

The main casing 2 includes a front cover 2A and a discharge tray 2B. The discharge tray 2B is positioned at an upper portion of the main casing 2. The sheet feeding portion 3 and the image forming portion 4 are disposed within the main casing 2. A developing cartridge 10 according to the embodiment can be attached to and removed from the main casing 2 while the front cover 2A is open.

The sheet feeding portion 3 is configured to accommodate the sheets S therein. The sheet feeding portion 3 is configured to feed the sheets S one by one to the image forming portion 4.

The image forming portion 4 includes a process cartridge 4A, an exposure device (not illustrated), a transfer roller 4B, and a fixing device 4C.

Figure 2:
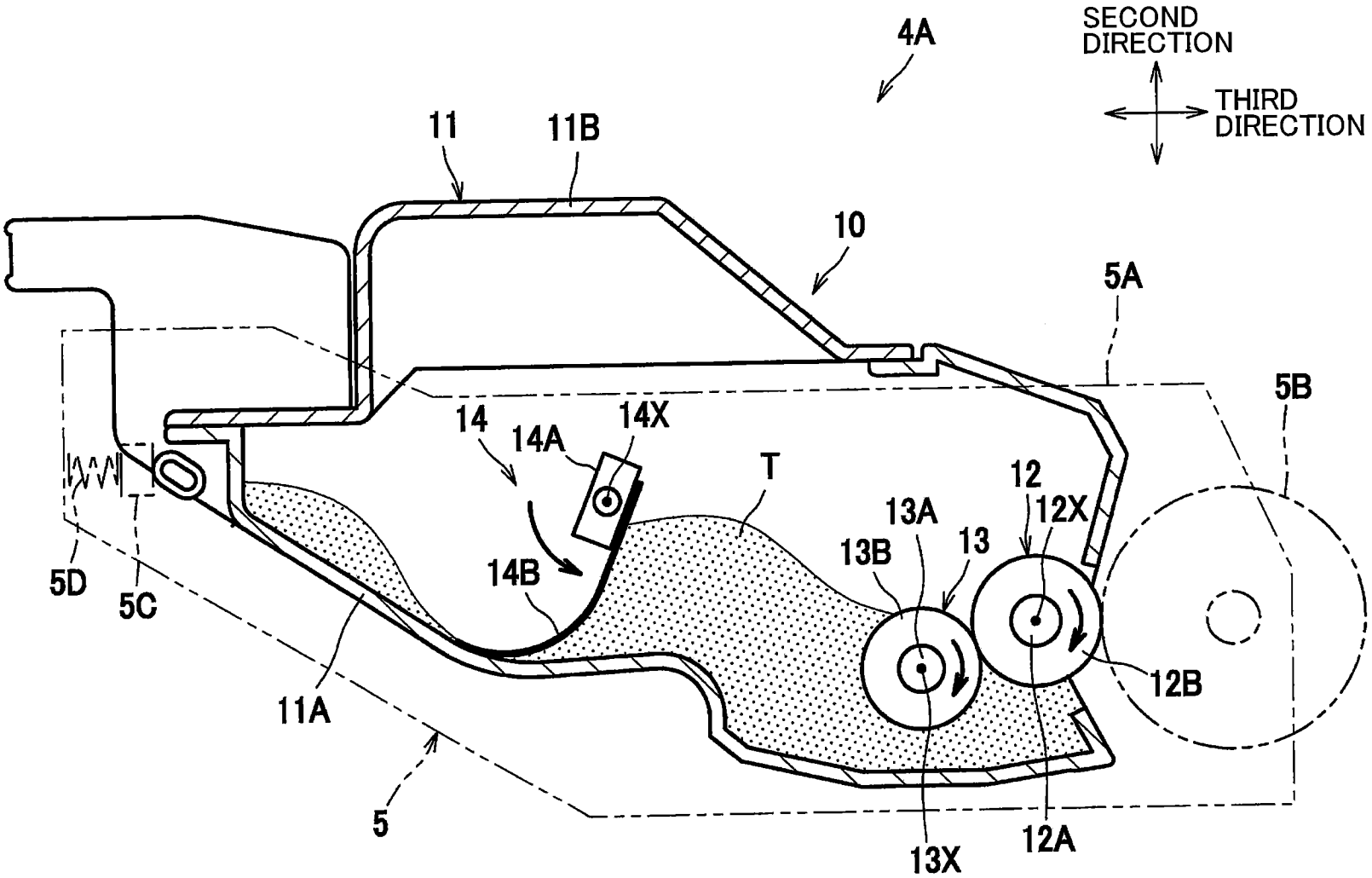
FIG. 2 is a vertical cross-sectional view of a process cartridge including the developing cartridge according to the embodiment.

As illustrated in FIGS. 1 and 2, the process cartridge 4A includes a drum cartridge 5 and the developing cartridge 10. The developing cartridge 10 can be attached to the drum cartridge 5. More specifically, the developing cartridge 10 can be attached to and removed from the drum cartridge 5. With the developing cartridge 10 attached to the drum cartridge 5, the developing cartridge 10 and the drum cartridge 5, as the process cartridge 4A, can be attached to and removed from the main casing 2 of the laser printer 1. The drum cartridge 5 includes a frame 5A, and a photosensitive drum 5B rotatably supported by the frame 5A.

As illustrated in FIG. 2, the developing cartridge 10 includes a housing 11, a developing roller 12, a supply roller 13, and an agitator 14.

The housing 11 includes a container 11A and a cover 11B. The container 11A of the housing 11 can accommodate toner T therein.

The developing roller 12 includes a developing-roller shaft 12A and a roller body 12B. The developing-roller shaft 12A and the roller body 12B extend in a first direction. The first direction denotes an axial direction of the developing roller 12 and will be referred to simply as the axial direction, hereinafter, wherever necessary. The developing-roller shaft 12A defines a first axis 12X extending in the axial direction. The developing-roller shaft 12A is made of metal, for example. The roller body 12B is provided over an outer peripheral surface of the developing-roller shaft 12A. The roller body 12B is made of an electrically conductive rubber, for example.

The developing roller 12 is rotatable about the first axis 12X of the developing-roller shaft 12A extending in the axial direction. The developing roller 12 is rotatably supported by the housing 11 so as to be rotatable about the first axis 12X of the developing-roller shaft 12A. That is, the roller body 12B is rotatable together with the developing-roller shaft 12A. The developing roller 12 is applied with a developing bias from the controller CU.

The container 11A and the cover 11B of the housing 11 face each other in a second direction. The second direction crosses the first direction. Preferably, the second direction is orthogonal to the first direction. The developing roller 12 is positioned at one end portion of the housing 11 in a third direction. The third direction crosses the first direction and the second direction. Preferably, the third direction is orthogonal to the first direction and the second direction.

The supply roller 13 includes a supply-roller shaft 13A and a roller body 13B. The supply-roller shaft 13A and the roller body 13B extend in the first direction. The supply-roller shaft 13A defines an axis 13X extending in the axial direction. The supply-roller shaft 13A is made of metal, for example. The roller body 13B is provided over an outer peripheral surface of the supply-roller shaft 13A. The roller body 13B is made of a sponge material, for example. The supply roller 13 is rotatable about the axis 13X of the supply-roller shaft 13A extending in the axial direction. The roller body 13B is rotatable together with the supply-roller shaft 13A.

The agitator 14 includes an agitator shaft 14A and a flexible sheet 14B. The agitator shaft 14A defines an axis 14X extending in the axial direction. The agitator shaft 14A is rotatable about the axis 14X. The agitator shaft 14A is rotatably supported by the housing 11 so as to be rotatable about the axis 14X. The agitator 14 is rotatable in accordance with rotation of a coupling 22 described later. The flexible sheet 14B has a base end fixed to the agitator shaft 14A. The flexible sheet 14B has a tip end configured to contact an inner surface of the housing 11. In accordance with rotation of the agitator 14, the agitator 14 is configured to agitate the toner T with the flexible sheet 14B.

The drum cartridge 5 includes a pressing member 5C and an urging member 5D. The urging member 5D is configured to urge the pressing member 5C toward the photosensitive drum 5B. The pressing member 5C urged by the urging member 5D is configured to contact the developing cartridge 10 attached to the drum cartridge 5 and urge the developing roller 12 against the photosensitive drum 5B. Hence, in a state where the developing cartridge 10 is attached to the drum cartridge 5, the developing roller 12 is pressed against the photosensitive drum 5B by the pressing member 5C and the urging member 5D.

As illustrated in FIG. 1, the transfer roller 4B faces the photosensitive drum 5B. The transfer roller 4B is configured to convey the sheet S with the sheet S nipped between the photosensitive drum 5B and the transfer roller 4B.

The photosensitive drum 5B is configured to be charged by a charger (not illustrated), and then exposed to light by the exposure device. An electrostatic latent image is thus formed on a peripheral surface of the photosensitive drum 5B. The toner T is then supplied to the electrostatic latent image to form a toner image on the photosensitive drum 5B. The toner image on the photosensitive drum 5B is then transferred onto the sheet S fed from the sheet feeding portion 3 while the sheet S passes between the photosensitive drum 5B and the transfer roller 4B.

After the toner image is transferred onto the sheet S, the fixing device 4C is configured to thermally fix the toner image to the sheet S. After the toner image is thermally-fixed to the sheet S, the sheet S is discharged out of the main casing 2 onto the discharge tray 2B.

The controller CU is configured to control overall operations of the laser printer 1.

The laser printer 1 includes a sensor 7. The sensor 7 is configured to detect whether the attached developing cartridge 10 is new, or a specification of the attached developing cartridge 10. The sensor 7 includes a lever 7A and an optical sensor 7B. The lever 7A is pivotably supported by the main casing 2. The lever 7A is disposed at such a position that the lever 7A can come into contact with detection protrusions 33A of a detection gear 33 (described later). The detection protrusions 33A can rotate together with the detection gear 33. The optical sensor 7B is electrically connected to the controller CU so that the optical sensor 7B can output a detection signal to the controller CU. The controller CU is configured to identify the specification of the attached developing cartridge 10, for example, based on the signal received from the optical sensor 7B. The optical sensor 7B is configured to detect displacement of the lever 7A and transmit a detection signal to the controller CU based on the detection. Specifically, the optical sensor 7B may be a sensor unit configured of a light emitter and a light receiver, for example.

Next, a detailed configuration of the developing cartridge 10 according to the embodiment will be described.

Figure 3:
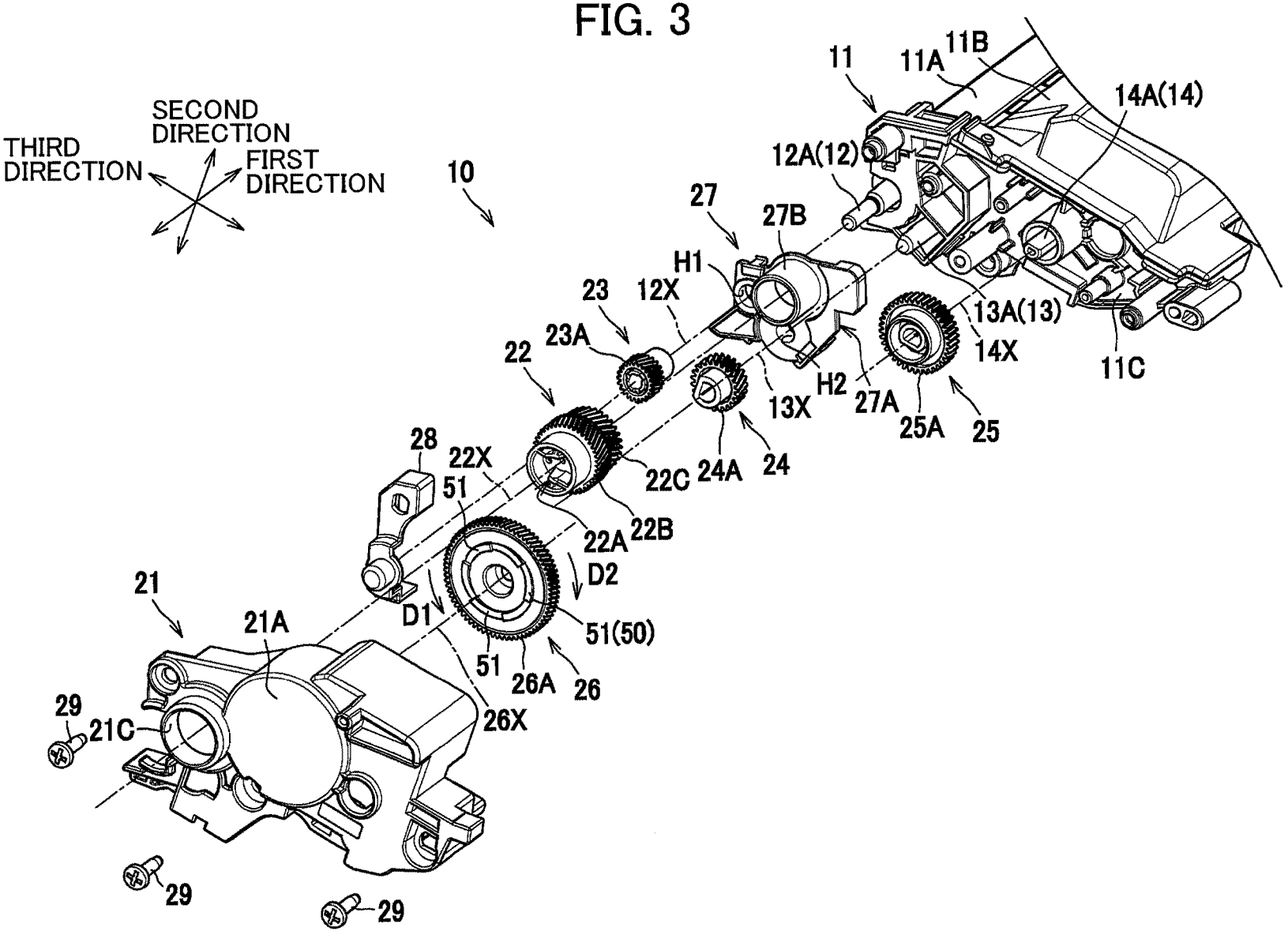
FIG. 3 is an exploded perspective view illustrating components constituting one end portion of the developing cartridge according to the embodiment in a first direction.

As illustrated in FIG. 3, the developing cartridge 10 includes the housing 11. The housing 11 has one end portion in the first direction. A first gear cover 21, the coupling 22, a developing gear 23, a supply gear 24, a first agitator gear 25, an idle gear 26, a first bearing member 27, and a cap 28 are disposed at the one end portion of the housing 11 in the first direction.

The first gear cover 21 includes a shaft 21B (see FIG. 5) for supporting the idle gear 26. The first gear cover 21 also covers at least one of the gears positioned at the one end portion of the housing 11 in the first direction. Specifically, the first gear cover 21 covers a portion of the coupling 22, the supply gear 24, the first agitator gear 25, and the idle gear 26. The first gear cover 21 is fixed to an outer surface 11C of the housing 11 with screws 29. That is, the first gear cover 21 is positioned at the outer surface 11C. The outer surface 11C is an outer surface of the one end portion of the housing 11 in the first direction.

The coupling 22 is configured to rotate the gears including the developing roller 12. The coupling 22 is rotatable in accordance with rotations of the developing roller 12 and other gears. The coupling 22 is rotatable about an axis 22X thereof extending in the axial direction. The coupling 22 is positioned at the one end portion of the housing 11 in the first direction. That is, the coupling 22 is positioned at the outer surface 11C. The coupling 22 is rotatable upon receipt of a driving force.

Specifically, the coupling 22 is configured to receive the driving force from the laser printer 1. The coupling 22 is rotatable by engagement with a driving member (not illustrated) provided in the laser printer 1. The coupling 22 has one end in the axial direction formed with a first recess 22A. The first recess 22A is recessed inward in the first direction. The first recess 22A is configured to receive the driving member to engage therewith. More specifically, the first recess 22A is configured to engage the driving member of the laser printer 1 to receive the driving force from the laser printer 1.

The coupling 22 includes a first gear 22B and a second gear 22C. The first gear 22B meshingly engages with the developing gear 23. The second gear 22C meshingly engages with the supply gear 24. The first gear 22B has a diameter that is different from a diameter of the second gear 22C. Specifically, the diameter of the first gear 22B is greater than the diameter of the second gear 22C.

The developing gear 23 is mounted to the developing-roller shaft 12A. The developing gear 23 is rotatable together with the developing roller 12 about the first axis 12X. The developing gear 23 is positioned at the one end portion of the housing 11 in the first direction. That is, the developing gear 23 is positioned at the outer surface 11C. The developing gear 23 includes a gear portion 23A. The gear portion 23A meshingly engages with the first gear 22B of the coupling 22.

The supply gear 24 is mounted to the supply-roller shaft 13A. The supply gear 24 is rotatable together with the supply roller 13 about the axis 13X extending in the axial direction. The supply gear 24 is positioned at the one end portion of the housing 11 in the first direction. That is, the supply gear 24 is positioned at the outer surface 11C. The supply gear 24 includes a gear portion 24A. The gear portion 24A meshingly engages with the second gear 22C of the coupling 22.

The first agitator gear 25 is mounted to the agitator shaft 14A. The first agitator gear 25 is rotatable about the axis 14X extending in the axial direction. The first agitator gear 25 is rotatable together with the agitator 14 in accordance with rotation of the coupling 22. The first agitator gear 25 is positioned at the one end portion of the housing 11 in the first direction. That is, the first agitator gear 25 is positioned at the outer surface 11C. The first agitator gear 25 includes a gear portion 25A. The gear portion 25A meshingly engages with the idle gear 26.

The idle gear 26 is positioned at the one end portion of the housing 11 in the first direction. That is, the idle gear 26 is positioned at the outer surface 11C. The idle gear 26 meshingly engages with the coupling 22 and the first agitator gear 25. Specifically, the idle gear 26 includes a large-diameter portion 26A and a small-diameter portion 26B (see FIGS. 4A and 4B). The large-diameter portion 26A meshingly engages with the first gear 22B of the coupling 22. The small-diameter portion 26B meshingly engages with the gear portion 25A of the first agitator gear 25. The idle gear 26 is rotatably supported by the shaft 21B (see FIG. 5) of the first gear cover 21. The idle gear 26 is rotatable about an axis 26X extending in the axial direction. The idle gear 26 functions to slow down a rotation speed of the coupling 22 and transmit the same to the first agitator gear 25. In the first direction, the large-diameter portion 26A is positioned farther away from the housing 11 than the small-diameter portion 26B is from the housing 11.

The idle gear 26 is rotatable in a first rotation direction D1 upon receipt of the driving force from the coupling 22. The idle gear 26 is also rotatable in a second rotation direction D2 opposite to the first rotation direction D1. That is, the idle gear 26 is supported by the first gear cover 21 and the housing 11 such that the idle gear 26 is rotatable in the first rotation direction D1 and the second rotation direction D2 relative to the first gear cover 21 and the housing 11.

The cap 28 covers one end portion of the developing-roller shaft 12A in the first direction. The cap 28 may be made of resin whose type is different from a type of resin which the first gear cover 21 is made of.

The first bearing member 27 rotatably supports the developing-roller shaft 12A, the supply-roller shaft 13A, and the coupling 22. The first bearing member 27 is secured to the one end portion of the housing 11 in the first direction. The first bearing member 27 includes a base portion 27A and a shaft 27B. The shaft 27B protrudes from the base portion 27A outward in the first direction.

The base portion 27A has a first insertion hole H1 and a second insertion hole H2. The developing-roller shaft 12A of the developing roller 12 is inserted in the first insertion hole H1. The supply-roller shaft 13A of the supply roller 13 is inserted in the second insertion hole H2.

The shaft 27B has a cylindrical shape. The shaft 27B rotatably supports the coupling 22. Specifically, an outer peripheral surface of the shaft 27B rotatably supports the coupling 22. An inner end of the shaft 27B (another end in the first direction) is closed by the base portion 27A.

As illustrated in FIG. 1, the developing cartridge 10 also includes a second gear cover 31, a second agitator gear 32, the detection gear 33, a second bearing member 34, a developing electrode 35, and a supply electrode 36, all of which are positioned at another end portion of the housing 11 in the first direction.

The second gear cover 31 covers at least a portion of the detection gear 33. The second gear cover 31 is positioned at an outer surface 11E of the housing 11. The outer surface 11E is an outer surface positioned at the other end portion of the housing 11 in the first direction. That is, the outer surface 11E is opposite the outer surface 11C in the first direction. The second gear cover 31 has an opening 31A formed therein. The portion of the detection gear 33 is exposed through the opening 31A.

The second agitator gear 32 is positioned at the other end portion of the housing 11 in the first direction. That is, the second agitator gear 32 is positioned at the outer surface 11E. The second agitator gear 32 is mounted to the agitator shaft 14A (see FIG. 2). The second agitator gear 32 is thus rotatable together with the agitator shaft 14A of the agitator 14 about the axis 14X extending in the axial direction.

The detection gear 33 is positioned at the other end portion of the housing 11 in the first direction. The detection gear 33 is rotatable by rotation of the second agitator gear 32 when the detection gear 33 comes to meshing engagement with the second agitator gear 32. The detection gear 33 includes a plurality of the detection protrusions 33A each configured to come into contact with the lever 7A of the sensor 7. Note that the number/positions of the detection protrusions 33A may be varied according to the specifications of the developing cartridge 10 so that the controller CU can identify the specification of the developing cartridge 10 in a state where the developing cartridge 10 is attached to the main casing 2 of the laser printer 1.

The second bearing member 34 rotatably supports the developing-roller shaft 12A and the supply-roller shaft 13A. The second bearing member 34 is fixed to the outer surface 11E while supporting the developing-roller shaft 12A and the supply-roller shaft 13A.

The developing electrode 35 is positioned at the other end portion of the housing 11 in the first direction. The developing electrode 35 is configured to supply electric power to the developing-roller shaft 12A. The developing electrode 35 is made of an electrically conductive resin, for example.

The supply electrode 36 is positioned at the other end of the housing 11 in the first direction. The supply electrode 36 is configured to supply electric power to the supply-roller shaft 13A. The supply electrode 36 is made of an electrically conductive resin, for example.

The developing electrode 35 and the supply electrode 36 are screw-fixed to the outer surface 11E of the housing 11, together with the second bearing member 34, with screws 38.

In the present embodiment, the coupling 22 serves as an example of a first helical gear, and the idle gear 26 serves as an example of a second helical gear. More specifically, as illustrated in FIG. 3, the first gear 22B of the coupling 22 is a helical gear with each gear tooth inclined relative to the first direction and a rotation direction of the coupling 22. The large-diameter portion 26A of the idle gear 26 is a helical gear with each gear tooth inclined relative to the first direction and a rotation direction of the idle gear 26. Here, the rotation direction of the idle gear 26 includes the first rotation direction D1 and second rotation direction D2.

Figure 4A:
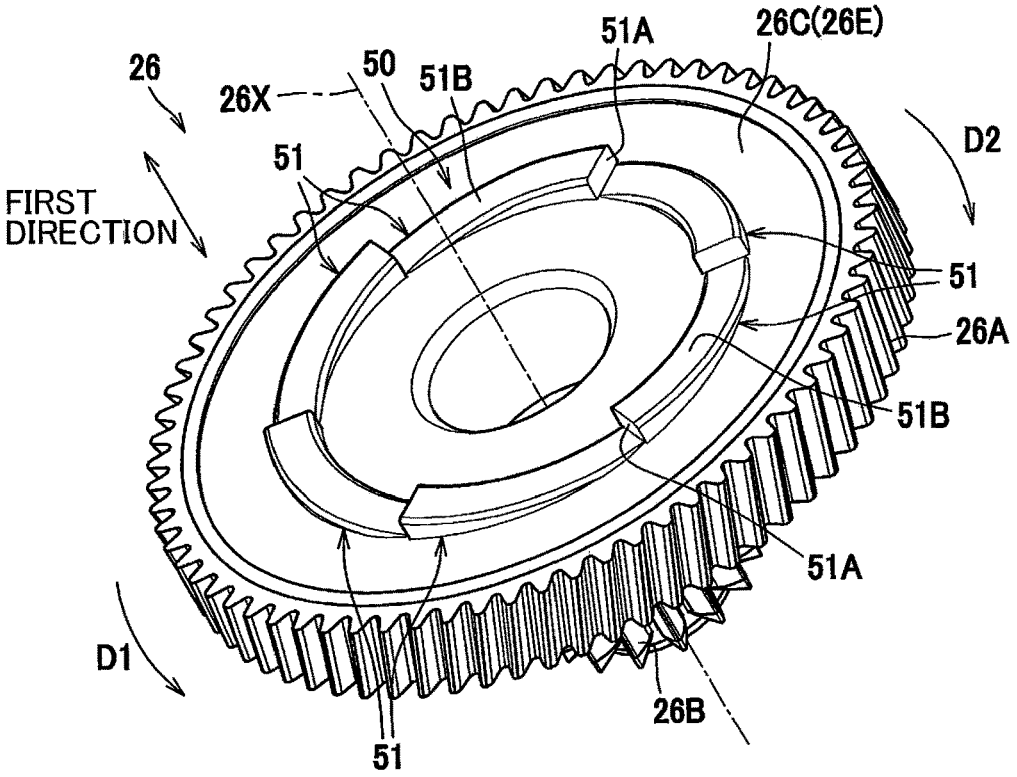
FIG. 4A is a perspective view of an idle gear of the developing cartridge according to the embodiment as viewed from a point outward thereof in the first direction.
Figure 4B:
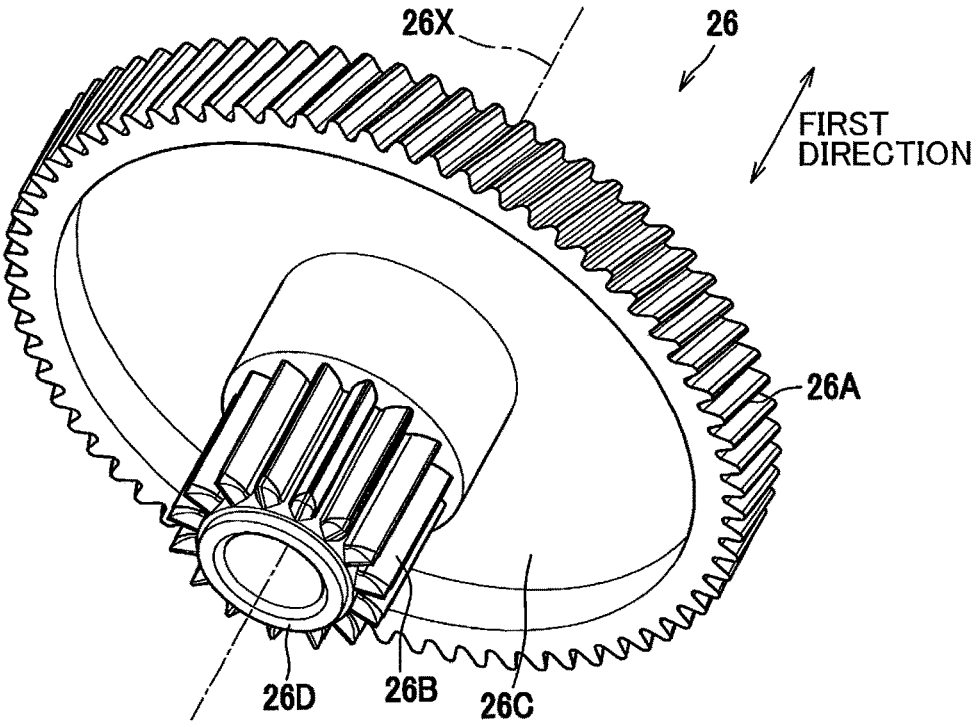
FIG. 4B is a perspective view of the idle gear of the developing cartridge according to the embodiment as viewed from a point inward thereof in the first direction.

As illustrated in FIGS. 4A and 4B, the idle gear 26 includes the large-diameter portion 26A, the small-diameter portion 26B, a disc portion 26C, a shaft portion 26D, and an engaging member 50.

The disc portion 26C has a disc shape centered on the axis 26X. The disc portion 26C has an end surface 26E facing a portion of the first gear cover 21 in the first direction. That is, the end surface 26E faces outward in the first direction.

The shaft portion 26D extends inward in the first direction from a center portion of the disc portion 26C. The shaft portion 26D has a cylindrical shape centered on the axis 26X. The shaft portion 26D of the idle gear 26 is supported by the shaft 21B (see FIG. 5) of the first gear cover 21 so that the shaft portion 26D is movable in the axial direction relative to the shaft 21B.

The idle gear 26 is movable between a first position (illustrated in FIG. 6) and a second position (illustrated in FIG. 7) in the axial direction. The idle gear 26 is positioned closer to the outer surface 11C at the first position (illustrated in FIG. 6) than at the second position (illustrated in FIG. 7) in the first direction. At the first position, the engaging member 50 and a part of the first gear cover 21 (first protrusions 41 described later) are disengaged from each other. That is, at the first position, the engaging member 50 and the part of the first gear cover 21 do not engage each other.

The idle gear 26 is positioned farther away from the outer surface 11C at the second position (illustrated in FIG. 7) than at the first position (illustrated in FIG. 6) in the first direction. At the second position, the engaging member 50 and the part of the first gear cover 21 (the first protrusions 41) are engaged with each other. More specifically, at the second position, the engaging member 50 and the part of the first gear cover 21 (a first surface 41A of each first protrusion 41 described later) are in engagement with each other in the second rotation direction D2.

As the idle gear 26 rotates, the large-diameter portion 26A of the idle gear 26 and the first gear 22B of the coupling 22 generate a thrust force. Specifically, as the idle gear 26 rotates in the first rotation direction D1, the large-diameter portion 26A and the first gear 22B generate a first thrust force F1 that causes the idle gear 26 to move inward in the first direction. In other words, as the idle gear 26 rotates in the first rotation direction D1, the large-diameter portion 26A and the first gear 22B generate the first thrust force F1, with which force the idle gear 26 is caused to move toward the outer surface 11C in the first direction. Thus, in a case where the idle gear 26 rotates in the first rotation direction D1, the idle gear 26 is moved to the first position by the first thrust force F1 generated by the meshing engagement between the idle gear 26 and the coupling 22.

As the idle gear 26 rotates in the second rotation direction D2, the large-diameter portion 26A and the first gear 22B generate a second thrust force F2. The second thrust force F2 causes the idle gear 26 to move outward in the first direction. In other words, as the idle gear 26 rotates in the second rotation direction D2, the large-diameter portion 26A and the first gear 22B generate the second thrust force F2, with which force the idle gear 26 is caused to move toward the first gear cover 21 in the first direction. Thus, in a case where the idle gear 26 rotates in the second rotation direction D2, the idle gear 26 is moved to the second position by the second thrust force F2 generated by the meshing engagement between the idle gear 26 and the coupling 22.

Note that the coupling 22 is immovable in the axial direction relative to the housing 11, since the coupling 22 is in contact with the first gear cover 21 or the first bearing member 27. In the present disclosure, the description "immovable in the axial direction relative to the housing 11" includes both cases: the coupling 22 does not move at all relative to the housing 11; and the coupling 22 does move slightly relative to the housing 11 due to play or backlash therebetween.

The engaging member 50 illustrated in FIG. 4A serves to allow rotation of the idle gear 26 in the first rotation direction D1. The engaging member 50 further serves to restrict rotation of the idle gear 26 in the second rotation direction D2.

The engaging member 50 is rotatable about the axis 26X together with the idle gear 26. Specifically, the engaging member 50 is rotatable, together with the idle gear 26, in the first rotation direction D1 and in the second rotation direction D2.

The engaging member 50 is also movable in the axial direction together with the idle gear 26. Specifically, the engaging member 50 is movable in the axial direction between the first position (illustrated in FIG. 6) and the second position (illustrated in FIG. 7) together with the idle gear 26. While the idle gear 26 is at the first position, the engaging member 50 and the part of the first gear cover 21

(the first protrusions 41) are disengaged from each other. While the idle gear 26 is at the second position, the engaging member 50 and the part of the first gear cover 21 are engaged with each other.

While the idle gear 26 is at the first position, the engaging member 50 is also at the first position together with the idle gear 26. At this time, the idle gear 26 is rotatable in conjunction with rotations of the coupling 22 and the developing gear 23, for example. While the idle gear 26 is at the second position, the engaging member 50 is also at the second position together with the idle gear 26. At this time, the engaging member 50 and the part of the first gear cover 21 are in engagement with each other. The engagement between the engaging member 50 and the part of the first gear cover 21 prevents the idle gear 26 from rotating further in the second rotation direction D2.

As illustrated in FIG. 3, in the present embodiment, the second gear 22C of the coupling 22, the gear portion 23A of the developing gear 23, and the gear portion 24A of the supply gear 24 are also helical gears with each gear tooth inclined relative to the first direction and corresponding rotation direction. In the embodiment, the developing gear 23 and the supply gear 24 are also immovable in the axial direction relative to the housing 11, similar to the coupling 22.

Specifically, the developing gear 23 and the supply gear 24 are immovable in the axial direction relative to the housing 11, since the developing gear 23 and the supply gear 24 are in contact with the first gear cover 21 or the first bearing member 27. Alternatively, the developing gear 23 and the supply gear 24 may be fixed to the developing-roller shaft 12A and supply-roller shaft 13A, respectively, in order to make the developing gear 23 and the supply gear 24 immovable in the axial direction relative to the housing 11.

Figure 5:
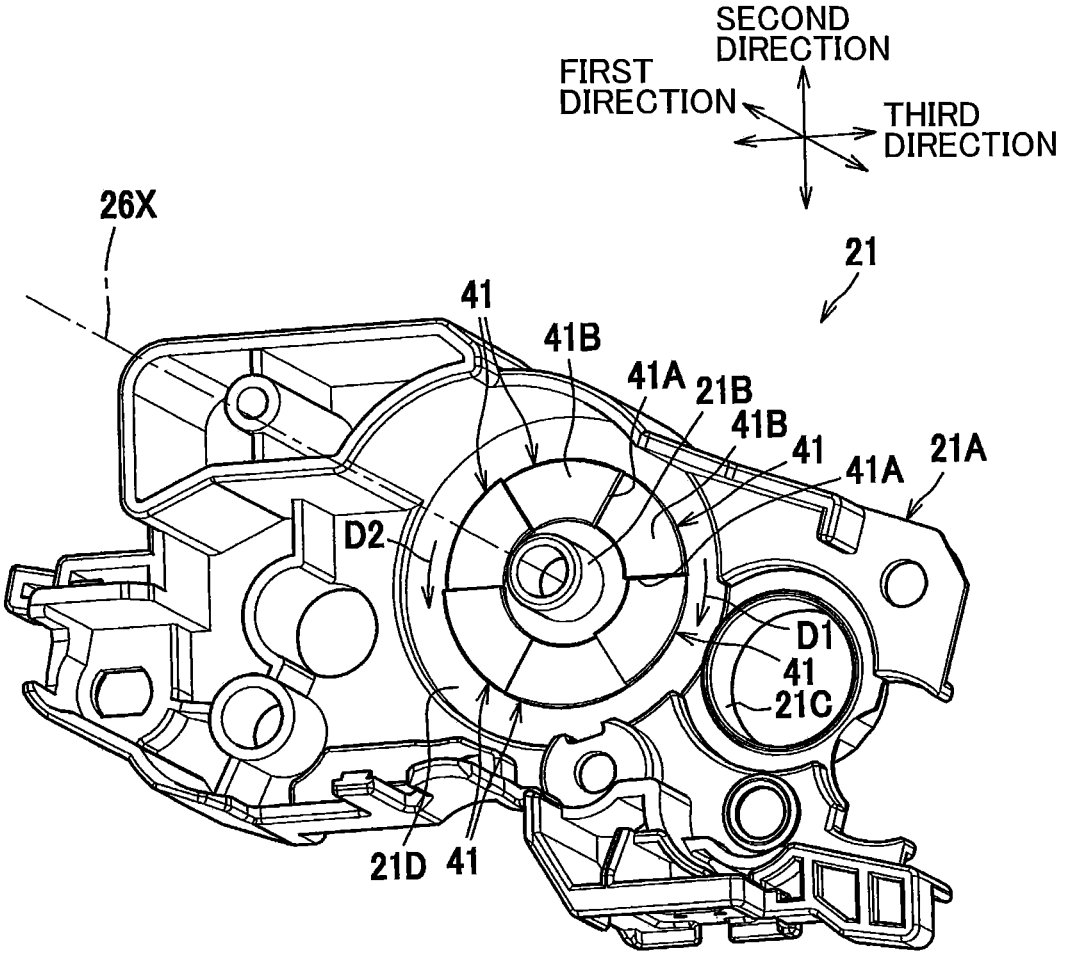
FIG. 5 is perspective view illustrating an inner structure of a first gear cover of the developing cartridge according to the embodiment.

As illustrated in FIG. 5, the first gear cover 21 includes a side wall 21A, the shaft 21B, and an opening 21C.

The side wall 21A has an opposing surface 21D facing the idle gear 26 in the first direction. The opposing surface 21D is part of a surface of the side wall 21A facing inward in the first direction. The opposing surface 21D is positioned at another end portion of the side wall 21A in the first direction. The opposing surface 21D has a circular shape centered on the axis 26X.

The shaft 21B protrudes from the opposing surface 21D of the side wall 21A inward in the first direction. The shaft 21B has a cylindrical shape centered on the axis 26X. The shaft 21B rotatably supports the idle gear 26. Specifically, an outer peripheral surface of the shaft 21B rotatably supports the idle gear 26.

The opening 21C serves to expose a part of the coupling 22 therethrough. More specifically, the first recess 22A is exposed through the opening 21C. The coupling 22 is thus allowed to engage the driving member (not shown) of the laser printer 1.

The first gear cover 21 includes the plurality of first protrusions 41. Specifically, the first gear cover 21 has six of the first protrusions 41. Each of the first protrusions 41 has an arcuate shape centered on the axis 26X. Each first protrusion 41 protrudes from the opposing surface 21D inward in the axial direction. The first protrusions 41 are positioned to surround the shaft 21B. The first protrusions 41 are arranged in the rotation direction of the idle gear 26. The first protrusions 41 are arranged to form an annular shape. Each of the first protrusions 41 has a first surface 41A and a second surface 41B. The first surface 41A extends in the first direction. The second surface 41B is inclined relative to the first direction.

The first surfaces 41A function to restrict the idle gear 26 from rotating in the second rotation direction D2. The first surfaces 41A extend to cross the rotation direction of the idle gear 26. Preferably, the first surfaces 41A are orthogonal to the rotation direction of the idle gear 26. As the idle gear 26 rotates in the second rotation direction D2, the first surfaces 41A face the engaging member 50 and come into contact therewith in the second rotation direction D2. The first surfaces 41A thus prevent rotation of the idle gear 26 in the second rotation direction D2.

The second surfaces 41B function to move the idle gear 26 and the engaging member 50 from the second position toward the first position in accordance with rotation of the idle gear 26 in the first rotation direction D1. The second surfaces 41B are inclined relative to the rotation direction of the idle gear 26. Specifically, each second surface 41B is inclined such that the second surface 41B extends inward in the first direction toward downstream in the first rotation direction D1. More specifically, each second surface 41B is inclined such that the second surface 41B separates away from the opposing surface 21D toward downstream in the first rotation direction D1. Hence, as the idle gear 26 rotates in the first rotation direction D1, the second surfaces 41B face and come into contact with the engaging member 50 in the first rotation direction D1. The idle gear 26 thus moves toward the first position as the engaging member 50 moves inward in the first direction over the second surfaces 41B.

As illustrated in FIG. 4A, the engaging member 50 is positioned on the end surface 26E of the disc portion 26C of the idle gear 26. The engaging member 50 includes a plurality of second protrusions 51. Specifically, the engaging member 50 includes six of the second protrusions 51. Each of the second protrusions 51 has an arcuate shape centered on the axis 26X. Each second protrusion 51 protrudes outward in the first direction from the end surface 26E of the disc portion 26C. The second protrusions 51 are positioned around the axis 26X. The second protrusions 51 are aligned with one another in the rotation direction of the idle gear 26. The second protrusions 51 are arranged to form an annular shape.

The second protrusions 51 are formed integrally with the disc portion 26B. The second protrusions 51 are part of the idle gear 26. That is, the idle gear 26 includes the plurality of second protrusions 51. Put different way, the idle gear 26 includes the engaging member 50.

Each second protrusion 51 has a third surface 51A and a fourth surface 51B. The third surface 51A extends in the first direction. The fourth surface 51B is inclined relative to the first direction.

The third surfaces 51A function to restrict the idle gear 26 from rotating in the second rotation direction D2. The third surfaces 51A extend to cross the rotation direction of the idle gear 26. Preferably, the third surfaces 51A are orthogonal to the rotation direction of the idle gear 26. The third surfaces 51A are configured to come into contact with the first surfaces 41A of the first protrusions 41, respectively. More specifically, the third surfaces 51A are configured to make surface-contact with the corresponding first surfaces 41A.

The fourth surfaces 51B function to move the idle gear 26 from the second position to the first position while the idle gear 26 rotates in the first rotation direction D1. The fourth surfaces 51B are each inclined relative to the rotation direction of the idle gear 26. Specifically, each fourth surface 51B is inclined such that the fourth surface 51B extends inward in the first direction toward downstream in the first rotation direction D1. That is, the fourth surfaces 51B are inclined such that the fourth surface 51B approaches the end surface 26E toward downstream in the first rotation direction D1. The fourth surfaces 51B are configured to contact the second surfaces 41B of the first protrusions 41, respectively. Specifically, the fourth surfaces 51B are respectively configured to make surface-contact with the second surfaces 41B.

Note that a length of each second protrusion 51 in the first direction is substantially identical to a length of each first protrusion 41 of the first gear cover 21 in the first direction.

Further, a moving distance of the idle gear 26 from the second position to the first position is greater than the lengths of each first protrusion 41 and each second protrusion 51 in the first direction. With this structure, when the idle gear 26 is at the first position, the engagement between each second protrusion 51 and corresponding first protrusion 41 of the first gear cover 21 can be reliably released. Hence, when the idle gear 26 is at the first position, the second protrusions 51 can be reliably separated from the corresponding first protrusions 41 of the first gear cover 21 in the first direction. The second protrusions 51 and the first protrusions 41 can thus be prevented from interfering with each other in a case where the idle gear 26 rotates in the first rotation direction D1 together with the engaging member 50.

Next, operations of the developing cartridge 10 will be described. Specifically, operations of the developing cartridge 10 attached to the drum cartridge 5 will be described hereinafter. That is, description will be given on how the idle gear 26 operates while rotating in the first rotation direction D1 or in the second rotation direction D2 in a state where the developing roller 12 is pressed against the photosensitive drum 5B by the pressing member 5C and the urging member 5D.

Figure 6:
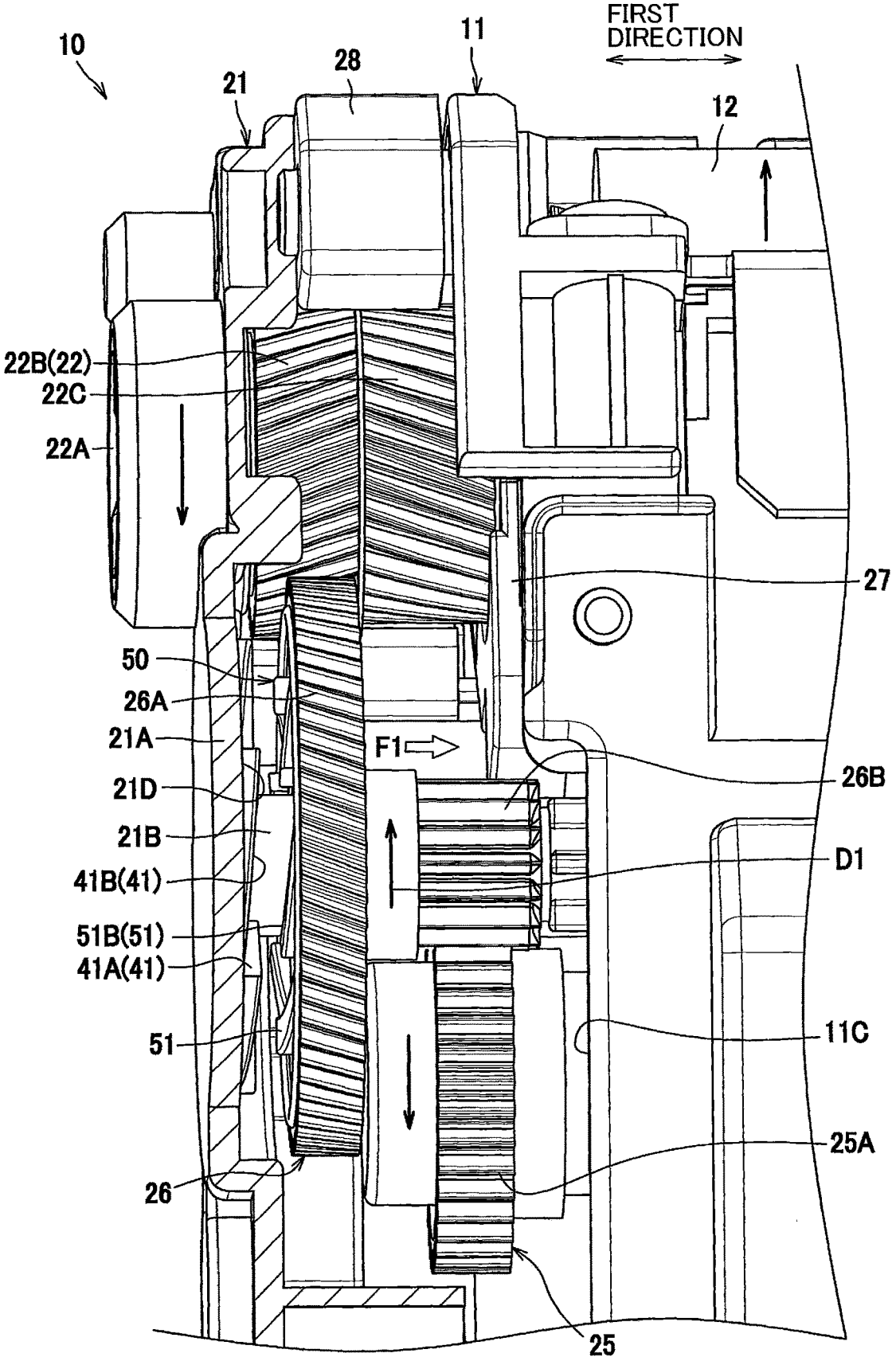
FIG. 6 is a view illustrating gears and the first gear cover of the developing cartridge according to the embodiment as viewed from a point outward thereof in a second direction in a state where the idle gear is at a first position.

As illustrated in FIG. 6, when the idle gear 26 is at the first position, the second protrusions 51 of the engaging member 50 are separated away from the opposing surface 21D of the first gear cover 21 in the axial direction. Hence, at this time, the second protrusions 51 are disengaged from the first protrusions 41 of the first gear cover 21.

As the coupling 22 rotates upon receipt of a driving force from the laser printer 1 for printing in the state where the idle gear 26 is at the first position, the idle gear 26 is caused to rotate in the first rotation direction D1. In accordance with rotation of the coupling 22, the developing gear 23, the supply gear 24, and the first agitator gear 25 are also caused to rotate. The developing roller 12, the supply roller 13, and the agitator 14 thus rotate respectively in prescribed directions, as illustrated by arrows in FIG. 2.

Here, there are conventionally known image forming apparatuses that can form images on both sides of each sheet. In order to perform such both-side printing, conventional image forming apparatuses are configured to form image on one side of a sheet at an image forming portion, then reverse the sheet and convey the reversed sheet back to a position upstream of the image forming portion in a sheet-conveying direction, and subsequently form an image on the back side of the sheet.

In such conventional image forming apparatuses, a photosensitive drum may be caused to rotate in a predetermined direction for performing image formation on each sheet, whereas the photosensitive drum may rotate in a direction opposite to the predetermined direction in order to reverse the sheet. In this configuration, a developing roller may be caused to rotate in reverse following the reverse rotation of the photosensitive drum. However, the structure according to the embodiment can prevent the developing roller 12 from rotating in reverse following the reverse rotation of the photosensitive drum 5B.

Figure 7:
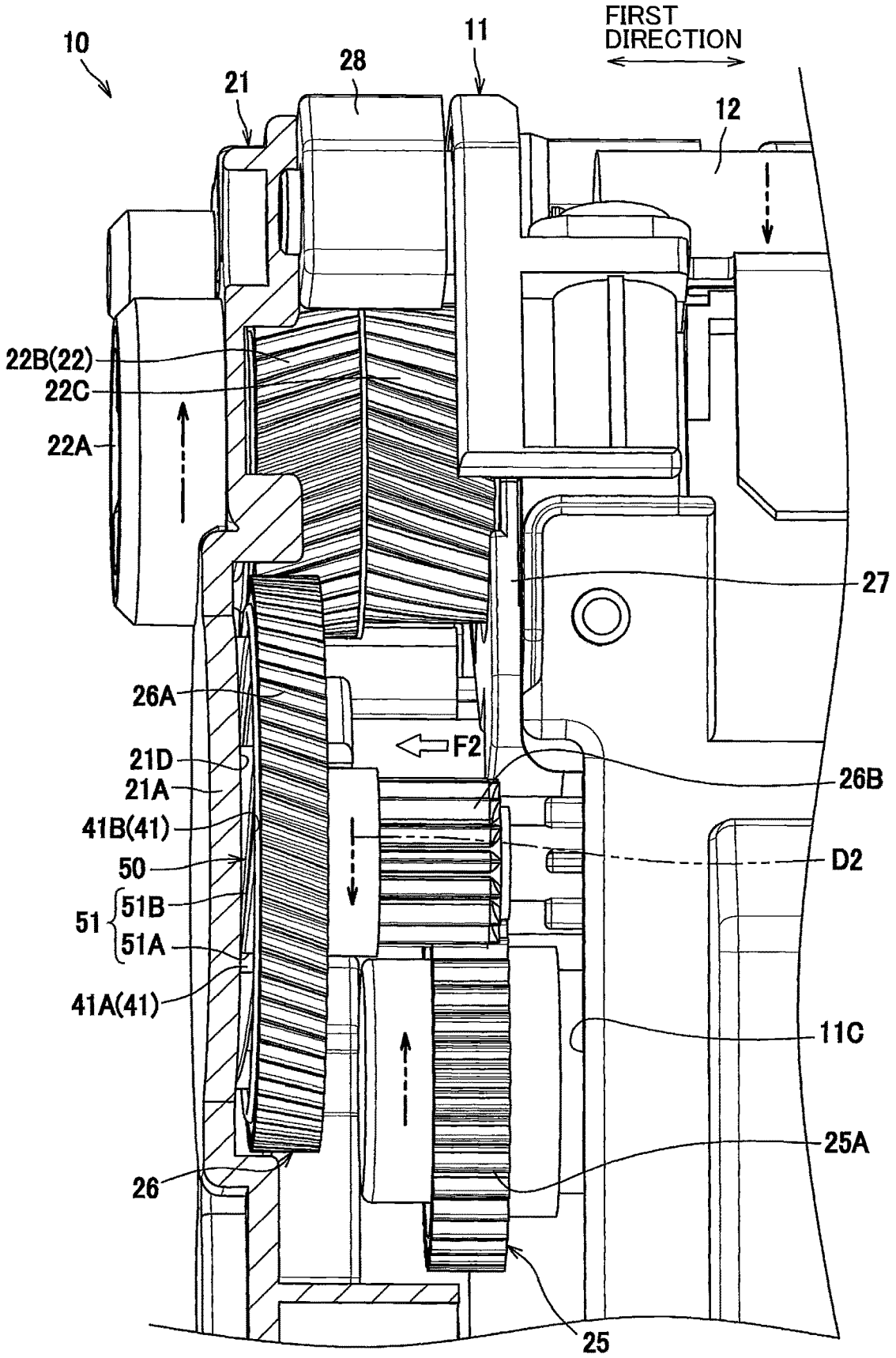
FIG. 7 is a view illustrating the gears and the first gear cover of the developing cartridge according to the embodiment as viewed from a point outward thereof in the second direction in a state where the idle gear is at a second position.

Specifically, in the present embodiment, in a case where the developing roller 12 rotates in reverse due to the reverse rotation of the photosensitive drum 5B while the idle gear 26 is at the first position illustrated in FIG. 6, the idle gear 26 rotates in the second rotation direction D2 through rotations of the developing gear 23 and the coupling 22. As a result, as illustrated in FIG. 7, the idle gear 26 is caused to move toward the second position by the second thrust force F2 generated by the meshing engagement between the coupling 22 and the idle gear 26. The idle gear 26 is positioned closer to the opposing surface 21D of the first gear cover 21 at the second position than at the first position.

When the idle gear 26 arrives at the second position, the second protrusions 51 of the engaging member 50 engages the corresponding first protrusions 41 of the first gear cover 21. Since the idle gear 26 is rotating in the second rotation direction D2 at this time, the engaging member 50 also rotates in the second rotation direction D2 together with the idle gear 26. The third surfaces 51A of the second protrusions 51 of the engaging member 50 thus come into contact with the first surfaces 41A of the first protrusions 41, respectively. This contact prevents the engaging member 50 from rotating further in the second rotation direction D2. The idle gear 26 integral with the engaging member 50 is thus prevented from rotating further in the second rotation direction D2.

In response to halt of the rotation of the idle gear 26, rotations of the coupling 22, rotations of the developing gear 23, the supply gear 24, and the first agitator gear 25 are also terminated. The developing roller 12, the supply roller 13, and the agitator 14 are caused to stop rotating, accordingly. The developing roller 12, the supply roller 13, and the agitator 14 are therefore prevented from rotating in reverse.

The coupling 22 rotates upon receipt of the driving force from the laser printer 1 while the idle gear 26 is at the second position. As the coupling 22 rotates, the idle gear 26 is caused to rotate in the first rotation direction D1. The idle gear 26 is therefore moved from the second position toward the first position by the first thrust force F1 generated by the meshing engagement between the coupling 22 and the idle gear 26.

As the idle gear 26 rotates in the first rotation direction D1, the engaging member 50 also rotates in the first rotation direction D1 together with the idle gear 26. The fourth surfaces 51B of the second protrusions 51 of the engaging member 50 are brought into contact with the second surfaces 41B of the first protrusions 41, respectively. As the engaging member 50 further rotates in the first rotation direction D1 together with the idle gear 26, the fourth surfaces 51B respectively move over the corresponding second surfaces 41B. The engaging member 50 thus moves toward the first position together with the idle gear 26. In this way, the second surfaces 41B and the fourth surfaces 51B serve to assist movement of the engaging member 50 and the idle gear 26 from the second position to the first position.

As illustrated in FIG. 6, when the idle gear 26 arrives at the first position, the idle gear 26 comes into contact with the housing 11. The idle gear 26 is thus prevented from moving further inward in the first direction. When the idle gear 26 arrives at the first position, the second protrusions 51 of the engaging member 50 are disengaged from the respective first protrusions 41 of the first gear cover 21. The idle gear 26 can therefore continue to rotate in the first rotation direction D1 thereafter.

The operations described above can also be realized even in a state where the developing cartridge 10 is removed from the drum cartridge 5.

The embodiment described above can achieve technical and operational advantages described below.

As the idle gear 26 rotates in the first rotation direction D1, the engaging member 50 also rotates together with the idle gear 26. In a case where the idle gear 26 rotates in the second rotation direction D2, the idle gear 26 rotates slightly in the second rotation direction D2 but is then caused to stop rotating due to the engagement of the engaging member 50 with the first surfaces 41A of the first protrusions 41. The idle gear 26 is thus restricted from rotating further in the second rotation direction D2 opposite to the first rotation direction D1. With this structure of the embodiment, leakage of the toner T out of the housing 11 due to the reverse rotation of the developing roller 12 can be suppressed.

While the idle gear 26 is at the first position, the second protrusions 51 of the engaging member 50 are disengaged from the first protrusions 41 of the first gear cover 21. That is, the engaging member 50 is in separation from the first gear cover 21. With this structure, while the idle gear 26 is at the first position, the idle gear 26 is reliably rotatable in the first rotation direction D1.

Further, the idle gear 26 can be restricted from rotating in the second rotation direction D2 by the first surfaces 41A and the third surfaces 51A that are orthogonal to the rotation direction of the idle gear 26. Also, movement of the idle gear 26 and the engaging member 50 from the second position to the first position can be assisted by the second surfaces 41B and the fourth surfaces 51B both inclined relative to the rotation direction of the idle gear 26.

The first gear cover 21 includes the plurality of first protrusions 41. The engaging member 50 includes the plurality of second protrusions 51. As the idle gear 26 rotates in the second rotation direction D2, the plurality of the third surfaces 51A of the second protrusions 51 respectively come into contact with the plurality of the first surfaces 41A of the first protrusions 41. With this structure, the idle gear 26 can be reliably restricted from rotating in the second rotation direction D2.

Even in a state where the developing roller 12 is pressed onto the photosensitive drum 5B by the pressing member 5C and the urging member 5D of the drum cartridge 5, the idle gear 26 is rotatable in the first rotation direction D1 but substantially impossible to rotate in the second rotation direction D2.

It would be apparent to those skilled in the art that the embodiment described above is merely an example of the present disclosure and modifications and variations may be made therein without departing from the spirit of the disclosure.

For example, while the coupling 22 serves as the first helical gear and the idle gear 26 serves as the second helical gear in the depicted embodiment, the present disclosure is not limited to this configuration. For example, a first agitator gear may serve as the second helical gear. In this case, the first agitator gear may include a gear portion which is a helical gear, and an engaging portion having the same configuration as the engaging member 50 of the embodiment. Alternatively, a coupling, or a supply gear or a developing gear may serve as the second helical gear.

The first helical gear may be any gear, provided that the first helical gear meshes with the second helical gear. For example, in a case where a first agitator gear serves as the second helical gear, an idle gear may serve as the first helical gear. This idle gear may include a small-diameter portion which is a helical gear. Alternatively, in a case where a coupling serves as the second helical gear, a developing gear may serve as the first helical gear.

In the depicted embodiment, the plurality of first protrusions 41 are provided at the first gear cover 21. However, the first gear cover 21 may include a single first protrusion 41. Likewise, the engaging member 50 may include a single second protrusion 51, instead of the plurality of second protrusions 51 of the embodiment.

In the embodiment described above, both of the second surfaces 41B of the first protrusions 41 and the fourth surfaces 51B of the second protrusions 51 are inclined surfaces that are inclined relative to the rotation direction of the idle gear 26. However, only one of the second surfaces and fourth surfaces may be inclined surfaces.

In the embodiment described above, the engaging member 50 is integrally formed with the idle gear 26 serving as the second helical gear. However, the engaging member and the second helical gear may be separate components.

In the embodiment described above, the first gear cover 21 includes the first protrusions 41 as a portion engageable with the second protrusions 51. However, instead of protrusions, a cover may have holes each engageable with second protrusions. Specifically, the cover may have a portion formed with a first hole having a first surface and a second surface. The first hole may be a single hole or a plurality of holes. Further, the first hole may be a through-hole or a bottomed hole.

In the embodiment described above, the engaging member 50 includes the second protrusions 51 as a portion engageable with the first protrusions 41. However, instead of protrusions, an engaging member may have holes each engageable with first protrusions. Specifically, the engaging member may have a portion formed with a second hole having a third surface and a fourth surface. The second hole may be a single hole or a plurality of holes. Further, the second hole may be a through-hole or a bottomed hole.

In the embodiment described above, the first gear cover 21 covers a part of the coupling 22, the supply gear 24, the first agitator gear 25, and the idle gear 26. However, a cover positioned at an outer surface of a housing may only cover part of the second helical gear. Specifically, the cover may only cover a part of the second helical gear at which the engaging member is provided so that the cover can engage the engaging member.

In the embodiment described above, the developing cartridge 10 and the drum cartridge 5 are separate components. However, the developing cartridge 10 and the drum cartridge 5 may be integrally formed as a single component.

The monochrome laser printer 1 is described as an example of an image forming apparatus of the disclosure. However, the image forming apparatus of the disclosure may be a color image forming apparatus, an image forming apparatus configured to perform exposure with LEDs, a copying machine, or a multifunction device.

It should be apparent to those who skilled in the art that the embodiment and variations described above may be combined with one another as appropriate.

<Remarks>

The developing cartridge 10 is an example of a developing cartridge. The housing 11 is an example of a housing. The outer surface 11C is an example of an outer surface. The developing roller 12 is an example of a developing roller. The first axis 12X is an example of a first axis. The coupling 22 is an example of a first helical gear and an example of a coupling. The axis 22X is an example of a second axis. The idle gear 26 is an example of a second helical gear. The end surface 26E is an example of an end surface. The first rotation direction D1 is an example of a first rotational direction. The second rotation direction D2 is an example of a second rotational direction. The axis 26X is an example of a third axis. The first thrust force F1 is an example of a first thrust force. The second thrust force F2 is an example of a second thrust force. The first gear cover 21 is an example of a cover. The engaging member 50 is an example of an engaging member. The first surface 41A and second surface 41B are examples of a first surface and a second surface, respectively. The third surface 51A and fourth surface 51B are examples of a third surface and a fourth surface, respectively. The first protrusions 41 are an example of a first protrusion. The second protrusions 51 are an example of a second protrusion. The agitator 14 is an example of an agitator. The first agitator gear 25 is an example of an agitator gear. The developing gear 23 is an example of a developing gear. The first recess 22A is an example of a recess. The drum cartridge 5 is an example of a drum cartridge. The photosensitive drum 5B is an example of a photosensitive drum. The pressing member 5C is an example of a pressing member.

What is claimed is:

1. A developing cartridge comprising:

a housing configured to accommodate toner therein, the housing having an outer surface;

a developing roller rotatable about a first axis extending in an axial direction;

a first helical gear positioned at the outer surface and rotatable about a second axis extending in the axial direction, the first helical gear being rotatable in accordance with rotation of the developing roller;

a second helical gear positioned at the outer surface and rotatable in a first rotational direction and a second rotational direction opposite to the first rotational direction about a third axis extending in the axial direction, the second helical gear being movable in the axial direction between a first position and a second position positioned farther away from the outer surface than the first position is from the outer surface, the second helical gear being moved to the first position by a first thrust force generated by meshing engagement between the first helical gear and the second helical gear in a case where the second helical gear rotates in the first rotational direction, the second helical gear being moved to the second position by a second thrust force generated by the meshing engagement between the first helical gear and the second helical gear in a case where the second helical gear rotates in the second rotational direction;

a cover positioned at the outer surface and covering at least part of the second helical gear; and an engaging member rotatable about the third axis together with the second helical gear and movable in the axial direction together with the second helical gear, the second helical gear being rotatable in the first rotational direction in accordance with the rotation of the first helical gear in a case where the second helical gear is at the first position, the engaging member being engaged with a part of the cover to terminate the rotation of the second helical gear in the second rotational direction in a case where the second helical gear is at the second position.

2. The developing cartridge according to claim 1, wherein the engaging member is configured to disengage from the part of the cover when the second helical gear is at the first position.

3. The developing cartridge according to claim 1, wherein the engaging member is positioned at the second helical gear.

4. The developing cartridge according to claim 1, wherein the second helical gear has an end surface facing the part of the cover in the axial direction;

wherein the engaging member is positioned at the end surface; and wherein the part of the cover includes a first surface and a second surface, the first surface being configured to contact the engaging member to terminate the rotation of the second helical gear in the case where the second helical gear rotates in the second rotational direction, and the second surface being configured to contact the engaging member to move the second helical gear and the engaging member toward the first position in the case where the second helical gear rotates in the first rotational direction.

5. The developing cartridge according to claim 4, wherein the part of the cover comprises a first protrusion having the first surface and the second surface.

6. The developing cartridge according to claim 5, wherein the part of the cover comprises a plurality of the first protrusions aligned with one another in a rotating direction of the second helical gear including the first rotational direction and the second rotational direction.

7. The developing cartridge according to claim 4, wherein the engaging member has a third surface configured to contact the first surface, and a fourth surface configured to contact the second surface.

8. The developing cartridge according to claim 7, wherein the engaging member comprises a second protrusion having the third surface and the fourth surface.

9. The developing cartridge according to claim 8, wherein the engaging member comprises a plurality of the second protrusions aligned with one another in a rotating direction of the second helical gear including the first rotational direction and the second rotational direction.

10. The developing cartridge according to claim 1, wherein the second helical gear is an idle gear.

11. The developing cartridge according to claim 10, further comprising:

an agitator rotatable about a fourth axis extending in the axial direction, the agitator comprising an agitator shaft defining the fourth axis; and an agitator gear mounted to the agitator shaft and meshingly engaging with the idle gear.

12. The developing cartridge according to claim 10, wherein the first helical gear is a coupling configured to rotate the developing roller.

13. The developing cartridge according to claim 12, wherein the coupling has one end portion in the axial direction, the one end portion having a recess configured to receive a driving force.

14. The developing cartridge according to claim 12, wherein the developing roller comprises a developing roller shaft defining the first axis, the developing cartridge further comprising a developing gear mounted to the developing roller shaft, the coupling being meshingly engaged with the developing gear.

15. The developing cartridge according to claim 1, wherein the developing cartridge is attachable to and detachable from a drum cartridge including a photosensitive drum and a pressing member configured to press the developing roller against the photosensitive drum; and wherein the developing roller is pressed against the photosensitive drum in a state where the developing cartridge is attached to the drum cartridge.

16. The developing cartridge according to claim 1, wherein the cover further covers a part of the first helical gear.

17. The developing cartridge according to claim 1, wherein the first helical gear and the second helical gear are rotatably supported by the housing.

* * * * *